United States Patent [19]

Aizawa

[11] 4,378,167

[45] Mar. 29, 1983

[54] ELECTRONIC TIMEPIECE WITH FREQUENCY CORRECTION

[75] Inventor: Hitomi Aizawa, Suwa, Japan

[73] Assignee: Kabushiki Kaisha Suwa Seikosha, Tokyo, Japan

[21] Appl. No.: 135,028

[22] Filed: Mar. 28, 1980

[30] Foreign Application Priority Data

Mar. 29, 1979 [JP] Japan ..... 54-37532

[51] Int. Cl.[3] ..... G04B 17/12

[52] U.S. Cl. ..... 368/201

[58] Field of Search ..... 328/48; 368/184–189, 368/200–202, 47

[56] References Cited

U.S. PATENT DOCUMENTS

| | | | |
|---|---|---|---|
| 3,895,486 | 7/1975 | Hammer et al. | 368/201 |
| 3,916,612 | 11/1975 | Morokawa et al. | 368/201 |
| 3,922,844 | 12/1975 | Sakamoto | 368/201 |
| 4,023,344 | 5/1977 | Mukaiyama | 368/47 |
| 4,062,178 | 12/1977 | Sakamoto | 368/201 |
| 4,101,838 | 7/1978 | Aihara et al. | 368/201 X |
| 4,128,993 | 12/1978 | Maeda et al. | 368/187 |

*Primary Examiner*—Vit W. Miska

*Attorney, Agent, or Firm*—Blum, Kaplan, Friedman, Silberman & Beran

[57] ABSTRACT

A time correction circuit for an electronic timepiece comprising an oscillator circuit inputting a high frequency standard signal to a divider network, the divider network dividing down the standard signal in a plurality of stages. Correction data is periodically applied to a plurality of divider stages to advance or retard the timing rate when a selected stage achieves a preferred logic state. Occurrence of a logic state in a subsequent divider stage enables the circuits for the next periodic application of the correcting data. Coarse and fine adjustments can be made.

15 Claims, 8 Drawing Figures

| | $Q_5$ | $Q_4$ | $Q_3$ | $Q_2$ |
|---|---|---|---|---|
| -4 | 0 | 0 | 0 | 0 |
| -3 | 0 | 0 | 0 | 1 |
| -2 | 0 | 0 | 1 | 0 |
| -1 | 0 | 0 | 1 | 1 |
| 0 | 0 | 1 | 0 | 0 |
| +1 | 0 | 1 | 0 | 1 |
| +2 | 0 | 1 | 1 | 0 |
| +3 | 0 | 1 | 1 | 1 |
| | 1 | 0 | 0 | 0 |
| | 1 | 0 | 0 | 1 |
| | 1 | 0 | 1 | 0 |
| | 1 | 0 | 1 | 1 |
| | 1 | 1 | 0 | 0 |
| | 1 | 1 | 0 | 1 |
| | 1 | 1 | 1 | 0 |
| | 1 | 1 | 1 | 1 |
| | 0 | 0 | 0 | 0 |

| 41 | 40 | 39 | 38 | 37 | 36 | 35 | 34 | 13 | 12 | 11 |
|---|---|---|---|---|---|---|---|---|---|---|
| 0 | 0 | 0 | 0 | 0 | 0 | 0 | 1 | 1 | 0 | 0 |
| 0 | 0 | 0 | 0 | 0 | 0 | 1 | 0 | 1 | 0 | 1 |
| 0 | 0 | 0 | 0 | 0 | 1 | 0 | 0 | 1 | 1 | 0 |
| 0 | 0 | 0 | 0 | 1 | 0 | 0 | 0 | 1 | 1 | 1 |
| 0 | 0 | 0 | 1 | 0 | 0 | 0 | 0 | 0 | 0 | 0 |
| 0 | 0 | 1 | 0 | 0 | 0 | 0 | 0 | 0 | 0 | 1 |
| 0 | 1 | 0 | 0 | 0 | 0 | 0 | 0 | 0 | 1 | 0 |
| 1 | 0 | 0 | 0 | 0 | 0 | 0 | 0 | 0 | 1 | 1 |

ELECTRONIC TIMEPIECE WITH FREQUENCY CORRECTION

BACKGROUND OF THE INVENTION

This invention relates generally to an electronic timepiece, and more particularly to an electronic timepiece which is adjusted for inaccuracies of the oscillator circuit by periodic setting of the logic state of stages in the divider network in accordance with externally applied data. In a timepiece using a plurality of divider stages to divide down the high frequency signal of an oscillator, perfect timekeeping results when the oscillator outputs its signal at a precise frequency. However, because of an inability to precisely control all parameters in the manufacture of the oscillator circuit, an exact frequency signal is rarely produced. Corrections for these inaccuracies can be made within the oscillator circuit itself but this is costly and provides a limited range of adjustability.

What is needed is a timepiece where corrections for inaccuracies in the frequency signal output of the oscillator circuit are made in the divider stages to which the uncorrected signals are inputted.

SUMMARY OF THE INVENTION

Generally speaking, in accordance with the invention, an electronic timepiece including correction circuits for adjusting stages of the divider network in order to compensate for inaccuracies in the oscillator circuits is provided. The electronic timepiece comprises an oscillator circuit inputting a high frequency standard signal to a divider network, the divider network dividing down the standard signal in a plurality of stages. To compensate for errors in the oscillator circuit frequency, correction data is periodically applied to a plurality of divider stages to advance or retard the timing rate output of the divider network when a selected stage achieves a preferred logic state. Occurrence of a preferred logic state in a subsequent divider stage enables the circuits for the next periodic application of the correcting data. Coarse and fine adjustments can be made depending upon the number of divider stages which are corrected and their location in the chain of divider stages.

Accordingly, it is an object of this invention to provide an improved electronic timepiece which periodically compensates for inaccuracies in the frequency output of the oscillator circuit.

Another object of this invention is to provide an improved electronic timepiece which compensates for inaccuracies in the oscillator circuit without adjustment to the oscillator circuit itself.

A still further object of this invention is to provide an improved electronic timepiece which compensates for inaccuracies in the oscillator circuit by adjusting the condition of various stages in the divider network to which the oscillator circuit output signals are provided.

A still further object of this invention is to provide an improved electronic timepiece which compensates for inaccuracies in the oscillator circuit at periodic intervals and in response to predetermined correcting data.

Still other objects and advantages of the invention will in part be obvious and will in part be apparent from the specifications.

The invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

This invention relates to an electronic timepiece wherein signals from a time standard oscillator are divided down a divider network and the divider network output drives timekeeping means which output data for display of time. The circuitry in accordance with this invention digitally regulates the frequency of the signals outputted by the divider network to produce a desired design frequency for timekeeping. Thus, deviations from the design frequency which are caused in the oscillator circuit due to manufacturing variances, are corrected. Frequency adjustments over a wide range are provided by adjusting the dividing ratio of the divider network without altering the operating frequency of the oscillator circuit. Such frequency adjustment in the divider network is accomplished with a simple circuit arrangement.

Figure 1:
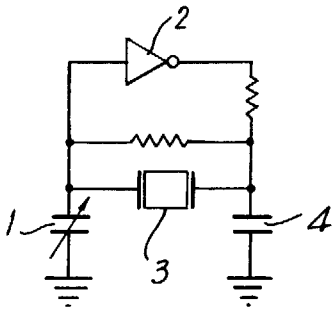
FIG. 1 PRIOR ART
FIG. 1 is the circuit of a convention oscillator having a crystal vibrator element.

A conventionally used frequency regulation circuit of the prior art is shown in FIG. 1 wherein regulation is made in the oscillator circuit itself. By adjusting a variable capacitor 1, the frequency of oscillation of the circuit is varied. However, there is a limit to the possible range of adjustment in frequency which can be produced by adjusting such a capacitor 1, and in the process, the vibration rate of a quartz crystal vibrator 3 is shifted away from the natural frequency of oscillation of the crystal. This adversely affects the stability of the oscillator circuit. Because only small variations in frequency can be accomplished by means of a variable capacitor 1, it is necessary that the quartz crystal vibrator 3 be manufactured with greater accuracy in order to minimize the initial frequency error. This required upgrading of manufacturing precision correspondingly increases the cost of production. The circuits in accordance with this invention provide easy regulation of output frequency without affecting the natural vibrational frequency of the crystal vibrator thus minimizing the disadvantages of the prior art which make high-precision fabrication of the crystal a requirement.

Figure 2:
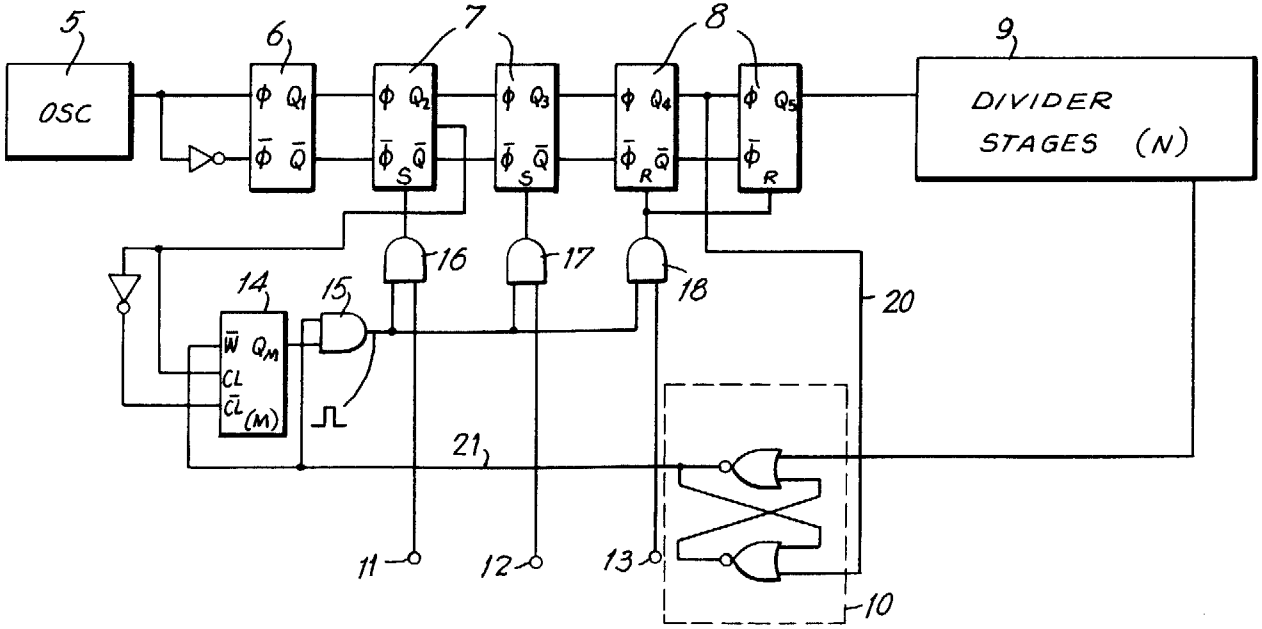
FIG. 2 is a partial circuit of an electronic timepiece in accordance with this invention.

A circuit in accordance with this invention is illustrated in FIG. 2, and includes an oscillator circuit 5; a flip-flop divider stage 6 receiving signals from the oscillator 5 and outputting a lower frequency signal; a pair of divider stages 7, each divider stage 7 having a set terminal S; a pair of divider stages 8, each stage 8 having a reset terminal R; a divider circuit 9 comprising N divider stages; a detecting circuit 10 which detects a specified logic state of a selected divider stage; and an output of the divider circuit 9 feeding signals to timekeeping circuits which drive a display. Every stage is a ½ circuit which halves the input frequency. The circuit further includes correction data terminals 11, 12, 13 which are used to present data for application to the divider stages 7, 8, latch circuit 14 and AND gates 15, 16, 17, 18.

Figure 8:
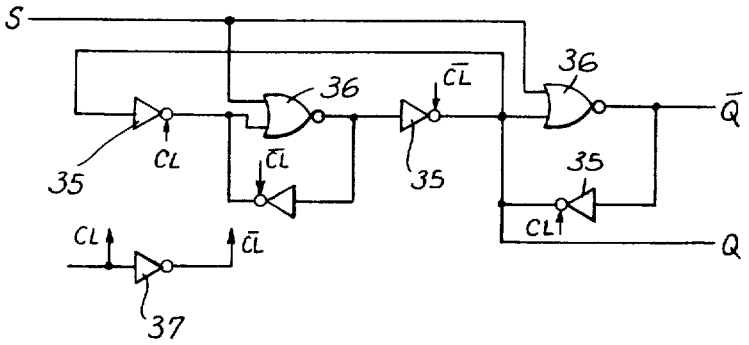
FIG. 8 is a representative circuit of a divider stage for the circuit of FIG. 2.

A detailed circuit of the ½ divider stages 7 with a set terminal S is shown in FIG. 8. The set terminal S is one input terminal of a NOR gate 36. When a logic 1 signal is applied to the set terminal S, the output $\overline{Q}$ becomes 0 and the output Q is made 1 automatically via an inverter 35. The ½ divider stages 8 having a reset terminal R are also realized with a substantially similar circuit as FIG. 8, wherein a gate is inserted in order to make the output $\overline{Q}$ have a logic 1 and the output Q have a logic 0 when the reset terminal R is made high by the application of a logic 1 signal. The inverters 35 are gated using opposite clock signals CL, $\overline{CL}$ at the gates to pass or block signals.

In FIG. 2, a latch circuit 14 and AND gates 15, 16, 17, 18 constitute a control circuit for regulating write-in of correcting signals to the divider stages 7, 8. Assume there is a small difference between the actual frequency of the output signal from the oscillator 5 and the design frequency, which is important to correct if high accuracy is to be achieved in the timepiece. In order to correct this difference between design frequency and actual oscillator output frequency, the write-in signal controlling circuit applies data signals available at terminals 11, 12, 13 to the divider stages 7, 8. Application of the data signals adjust a too rapid or slow oscillator frequency to the desired design value.

The concept for advancing or delaying the output frequency signal of the divider network by writing data into selected divider stages is explained with reference to FIG. 3 which is a table showing logic states of the output signals $Q_2$, $Q_3$, $Q_4$, $Q_5$ from the divider stages 7, 8 respectively, as shown in FIG. 2. In the conventional manner it can be seen from FIG. 3 that the logic states serve as a 4-bit counter with the frequency of change in the logic state at the output of each successive stage diminishing by the one/two ratio as the signal progresses from the oscillator through the counter stages. In this example, the output $Q_4$ of the divider stage 8 is used as the trigger signal for initiating a correction to the divider network.

When the logic stages $Q_2$, $Q_3$, $Q_4$, $Q_5$ are 0010 respectively, and the timepiece oscillator 5 is operating at the design frequency, then no corrections would be inputted through the data terminals 11, 12, 13 as explained more fully hereinafter. Any required corrections are initiated when the logic state $Q_4$ changes from 0 to 1. It should be noted that when data is written into the divider stages so that the logic outputs $Q_2$–$Q_5$ become 1100, it is as though the counter had been set back by one input pulse from the 0010 condition. When normal counting resumes after such a correction, then the output from the divider stages is delayed by one pulse. When correcting data is applied to the divider stages so that the logic outputs $Q_2$–$Q_5$ are 1010, the condition of the counter stages is advanced by one pulse from the 0010 condition. Thereby, the output from the divider network is advanced, that is, the timepiece is made to run faster. Thus, the output signal frequency from the divider stages 6–9 can be accelerated or retarded by altering the logic states of the output from selected divider stages at a particular time in the counting-down or dividing process. The circuit of FIG. 2 accomplishes such corrections.

In the initial stage, the output signal of the divider circuit 9 (FIG. 2) is at logic 1, and the detecting circuit 10 comprised of NOR gates outputs a signal at logic 0. When the output signal from the divider circuits 9 goes low, that is, logic 0, the output 21 of the detecting circuit 10 remains low and remains low until a logic 1 signal is input via the line 20. Thus, in the exemplary circuit of FIG. 2, when the output of $Q_4$ of the divider stage 8 becomes high, this signal is applied via line 20 to the detecting circuit 10 and produces a high or 1 output on the line 21. In response to the high output of the detecting circuit 10, a latch circuit 14 and an AND gate 15, receiving the high from the detecting circuit 10, output a differential pulse signal. This differential signal at the output of AND gate 15 is a command signal for writing data into the divider stages 7, 8. When the output of the AND gate 15 is high, correction data available at the terminals 11, 12, 13 is written into the divider stages 7, 8 through the AND gates 16, 17, 18, respectively.

For example, when the terminals 11, 12, 13 are all high, that is, logic 1, and the output of AND gate 15 is also high, then the outputs of AND gates 16, 17, 18 are high. With such outputs from gates 16, 17, 18, the outputs of $Q_2$ and $Q_3$ of the divider stages 7 are set to a logic 1. The outputs $Q_4$ and $Q_5$ of the divider stages 8 are reset and placed in the condition 0 because the output signal from the AND gate 18 is applied to both reset terminals R. In this way, the logic of the outputs $Q_2$–$Q_5$ of the divider stages 7, 8 is changed from 0010 to 1100. As shown in FIG. 3, the logic state is set back by one step, and thereby the output of the divider network is delayed and the rate of timekeeping is retarded. It will be apparent from FIG. 3 that various inputs at terminals 11, 12, 13 will produce selected degrees of acceleration or retardation in the rate of timekeeping.

The detecting circuit 10 is a reset-set flip-flop comprised of NOR gates. Once a high state at the output $Q_4$ is detected on line 20, the detecting circuit 10 does not return to the initial condition until the output from the N stage of the divider circuits 9 becomes logic 1. Accordingly, a command signal for write-in generated by the AND gate 15 detects the instant where the output $Q_4$ of the divider stage 8 becomes 1 for the first time after the output of the N stage of the divider circuits 9 changes from a logic 1 to a logic 0.

In the circuit embodiment in accordance with this invention shown in FIG. 2, a logic 0010 at the outputs $Q_2$–$Q_5$ is detected by detecting only the output $Q_4$. It should be readily understood that not only that particular logic state can be used as a trigger for correction, but also the logic state of any other divider stage can be used as the trigger for correction. Also, a pattern of logic states from several divider stages can be used as a trigger by feeding these signals to separate inputs of an AND gate placed intermediate of the divider stages and the input line 20 to the detecting circuit 10.

In the circuit embodiment of FIG. 2, the minimum value of adjustment which is possible, that is, the period of one pulse is $1/16384 \times 86400 \times 1/10 = 0.53$ sec/day, when the output from the N stage of the divider circuits 9 is a signal having a 10-second period and the output frequency $Q_1$ from the ½ divider stage 6 is 16384 Hz. With three data terminals 11, 12, 13 the frequency adjustment can be accomplished in a range between 2.11 seconds per day of delay and 1.58th seconds of advancement, that is, with reference to FIG. 3, there can be a modification in the logic states equivalent to four pulses of delay and three pulses of advancement.

Figure 4:
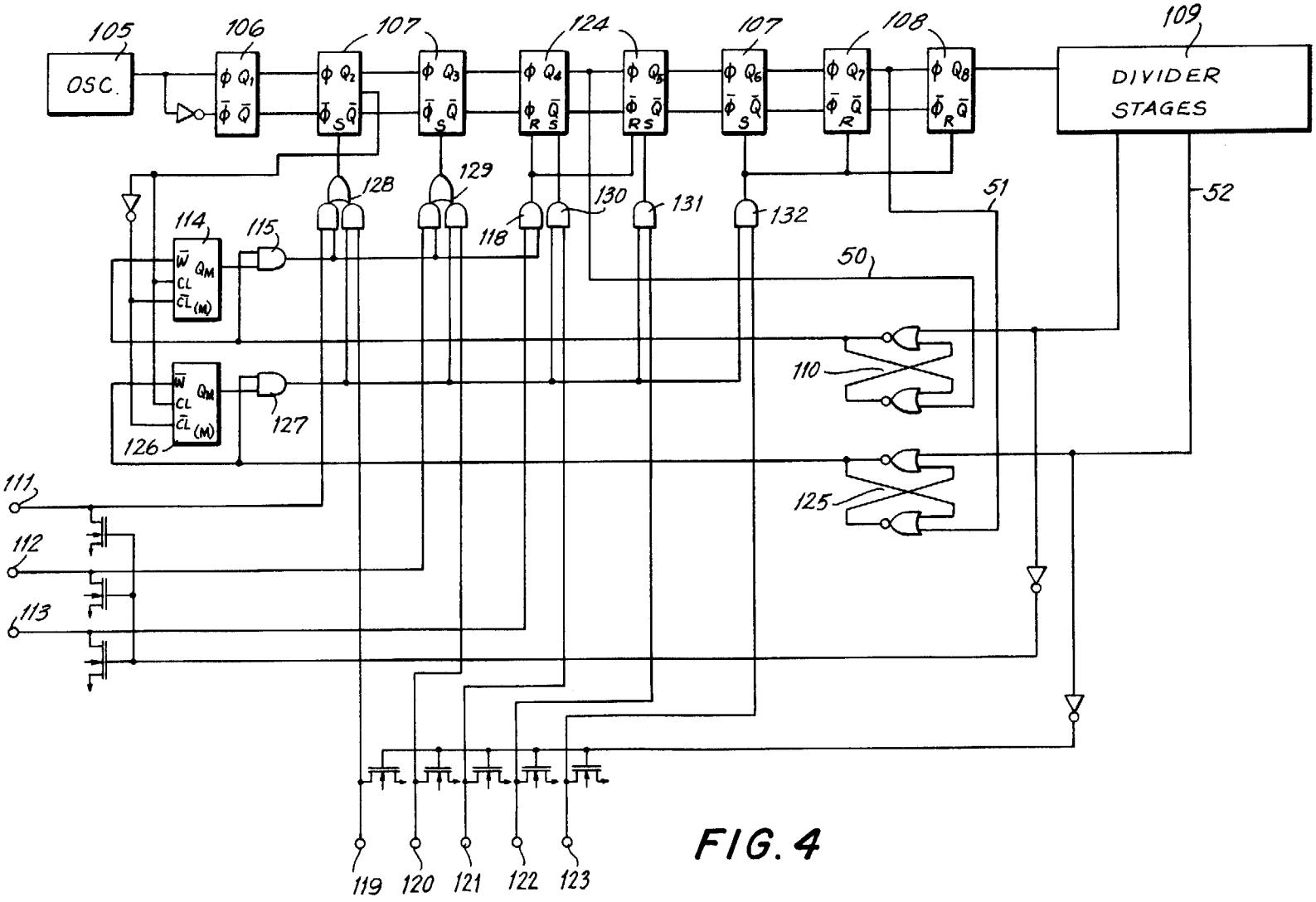
FIG. 4 shows a partial circuit of an alternative embodiment of an electronic timepiece in accordance with this invention.

FIG. 4 is an alternative circuit embodiment in accordance with this invention. The circuit is provided with five additional correction data terminals 119, 120, 121, 122, 123 which allow for precise adjustment of time. The circuit of FIG. 4 is similar to that of FIG. 2 and common elements are shown with reference numerals having a value of one hundred added thereto, for example, the oscillator 5 of FIG. 2 is identified as oscillator 105 in FIG. 4. Also, the circuit of FIG. 4 operates in substantially the same manner as described above in relation to FIG. 2, such that repetitious explanation of FIG. 4 is omitted herein.

There are two detector circuits 110, 125, with detector circuit 110 being associated with data terminals 111, 112, 113 and detector circuit 125 being associated with data terminals 119–123. The output $Q_4$ of a divider stage 124 provides the trigger via a connector 50 to a detector circuit 110, and the output $Q_7$ of a later divider stage 108 provides the trigger via a connector 51 to the detector circuit 125. Different stages of the divider circuits 109 are used to reset the detector circuits 110, 125. The signal from the divider circuits 109 provided via a connector 52 to the detector circuit 125 has a period of 120 seconds. A correction is made by means of the detector circuit 125 and the associated data terminals 119–123 when the logic states $Q_2$–$Q_7$ reach 000001 respectively. Then, through operation of a latch 126 and an AND gate 127, in a manner as described above, the output of the AND gate 127 goes high and correcting data from the terminals 119–123 is inputted to the divider stages 107, 124, 108. The minimum value of adjustment which may be achieved by means of the detector circuit 125 and its associated circuit components is $1/16384 \times 86400 \times 1/120 = 0.044$ seconds per day when the putput signal $Q_1$ of the stage 106 is 16384 Hz. Multiples of this correction are also readily available.

Again, with reference to the circuit of FIG. 4, a signal having a 10-second period is applied to the detector 110 from the divider circuits 109. This signal resets the detector 110, as described with reference to detector 10 of FIG. 2, and when the output $Q_4$ goes high thereafter, a latch 114 and AND gate 115 output a differential pulse signal which in conjunction with the data terminals 111–113 adjust the logic states on the first two stages 107 of FIG. 4 and divider stages 124. The smallest adjustment which can be effected every 10 seconds by means of the detector 110, associated circuit components and terminals is 0.53 seconds per day.

Thereby, rough adjustments and precise adjustments are independently accomplished. That is, a minimum rough adjustment of 0.53 second per day can be effected every 10 seconds and a minimum precise adjustment can be effected every 120 seconds in the amount of 0.044 seconds per day. Coarse and precise adjustments are alternated in response to the period of the respective frequency signals from the divider circuits 109 which are used to enable the detectors 110, 125. Note in FIG. 4, that the ½ divider stage 124 has both reset and set terminals R, S, and AND-OR gates 128, 129 respond to write-in data for both coarse and precise adjustments. Divider stages 107 have set terminals S and divider stages 108 have reset terminals R.

Figure 7:
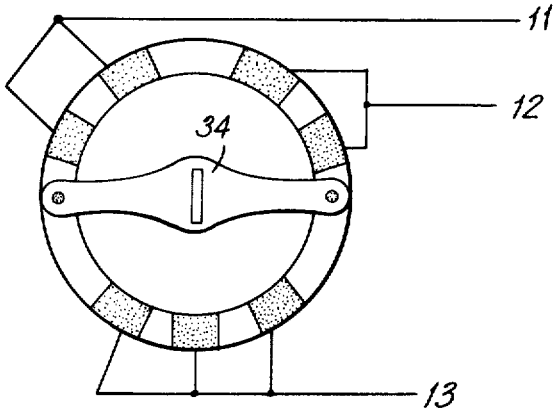
FIG. 7 is a rotary switch for producing logic state correction data.

The data which is presented at the data input terminals, 11–13, 111–113, 119–123 can be provided in many ways. For example, the condition of the data terminals may be fixed, e.g., by means of a ROM circuit which has a data code written into it to compensate for the oscillator's performance. The data may be provided from a programmable memory. Data can also be provided by electro-mechanical means. For example, it is possible to use a rotary switch as shown in FIG. 7. When a rotor 34 comes in contact with an electric terminal 11, 12, or 13, the logic on each terminal is made 1, and when no contact is made between the terminals and the rotor 34, the logic level at the terminals is 0. Thereby, various combinations of logic states are achieved. Also, the data at the input terminals can come from a counter where the outputs from respective digit positions of the counter are inputs to the data terminals and the counter drives every time a clock pulse is applied. This enables different combinations of inputs.

Figures 3, 5, 6:
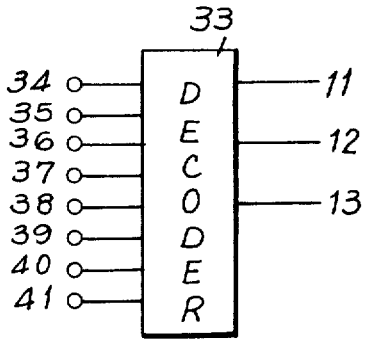
FIG. 3 is a table showing logic states of the outputs of selected divider stages of the circuit of FIG. 2.
FIG. 5 is a functional block diagram of a three bit to eight bit decoder.
FIG. 6 is a table of logic states associated with the decoder of FIG. 5.

Further, as shown in FIG. 5, it is also feasible that the logic states on correction data terminals be set in response to the output of a code converter. FIG. 6 is a table showing a 3-bit code being converted into signals suitable for application at eight data terminals. The frequency of correction, that is, for writing the data from the data terminals into the divider stages, depends on the repetition rate of changing the logic states of the detecting circuits. Thus, by tying the detecting circuits to different stages in the divider networks 9, 109 it is possible to select the frequency of occurrence of the correcting process. This makes it possible to choose any desired amount of regulation.

In accordance with this invention an electronic timepiece of high accuracy is easily realized. The circuit arrangements are simple in that correcting signals are provided only to the divider stages and the oscillator circuit is not adjusted. Also the data terminals are connected to a conventional divider network circuit arrangement. Thus, complexity and special circuitry is not introduced.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A time correction circuit for an electronic timepiece comprising:

an oscillator circuit outputting a high frequency standard signal;

a divider network having a plurality of divider stages in a chain of division, said divider network dividing down said high frequency standard signal, at least one of said divider stages having at least one of a setting and resetting input terminal;

means for timekeeping driven by the divided down output of said divider network;

means for imposing, when driven, a selected output condition on said at least one of said plurality of divider stages, said at least one divider stage being adapted for one of setting, resetting, and setting and resetting by a signal from said means for imposing, said signal being applied to said input terminal of said at least one divider stage outside of said chain of division;

at least one correction data terminal connected to said means for imposing, said at least one data terminal having a preselected logic condition thereon at the moment when said at least one divider stage is driven for one of setting and resetting for imposing a selected output signal, said pre-selected logic condition of said at least one data terminal determining said selected output condition on said at least one divider stage by said setting and resetting;

control means for driving, when actuated, said means for imposing a selected output condition;

detection means for sensing a first preferred output condition of one of said divider stages, said one stage being an intermediate stage of said divider network, said detection means, having sensed said first preferred output, being adapted to actuate said control means, said detection means for sensing being enabled by a second preferred output condition, from one of said plurality of divider stages, said second preferred output condition occurring periodically at a stage in said divider network after said first preferred output condition, occurrence of said first preferred output following said second preferred output causing a selected output on said at least one divider stage by said setting and resetting and the timing rate of said divider network is modified thereby.

2. The time correction circuit as claimed in claim 1, wherein said detection means is a set-reset circuit adapted to respond alternately to said first and second preferred output conditions.

3. The time correction circuit as claimed in claim 1, wherein said selected output is imposed by setting said at least one divider stage.

4. The time correction circuit as claimed in claim 1, wherein said selected output is imposed by resetting said at least one divider stage.

5. The time correction circuit as claimed in claim 1, wherein selected outputs are imposed on at least two divider stages, one of said at least two divider stages being reset, and another of said at least two divider stages being set by said imposition.

6. A time correction circuit for an electronic timepiece comprising:

an oscillator circuit outputting a high frequency standard signal;

a divider network having a plurality of divider stages in a chain of division, said divider network dividing down said high frequency standard signals, at least one of said divider stages having at least one of a setting and resetting input terminal;

means for timekeeping driven by the divided down output of said divider network;

means for imposing, when driven, a selected output condition on said at least one of said plurality of divider stages said at least one divider stage being adapted for one of setting, resetting and setting and resetting by a signal from said means for imposing, said signal being applied to said input terminal of said at least one divider stage outside of said chain of division;

at least one correction data terminal connected to said means for imposing, said at least one data terminal having a preseleted logic condition thereon at the moment when said at least one divider stage is driven for said setting and resetting for imposing a selected output signal, said pre-selected logic condition of said at least one data terminal determining said selected output condition on said at least one divider stage by said setting and resetting;

control means for driving, when actuated, said means for imposing a selected output condition;

detection means for sensing a first and a second preferred output condition of two of said divider stages, said two divider stages being intermediate stages of said divider network, said detection means having sensed said first and said second preferred output conditions, being adapted to actuate said control means, said detection means for sensing being enabled by a third and fourth preferred output condition, said third and fourth preferred output conditions occurring at stages in said divider network after said first and second preferred conditions, occurrence of said first and second preferred output conditions following said third and fourth preferred output conditions causing a selected output on said at least one divider stage by said setting and resetting and the timing rate of said divider network is modified thereby.

7. The time correction circuit as claimed in claim 6, wherein said third and fourth preferred output conditions are selected from different ones of said plurality of divider stages.

8. The time correction circuit as claimed in claim 7, wherein said third preferred output condition enables said detection means for sensing said first preferred output condition, and said fourth preferred output condition enables said detection means for sensing said second preferred output condition, whereby selected outputs are imposed at different repetition rates.

9. The time correction circuit as claimed in claim 8, wherein said detection means includes a pair of set-reset circuits, one said set-reset circuit being adapted to respond alternately to said first and third preferred output conditions and the other set-reset circuit being adapted to respond alternately to said second and fourth preferred output conditions.

10. The time correction circuit as claimed in claim 9, wherein selected outputs are imposed on at least two divider stages, one of said at least two divider stages being reset, and another of said at least two divider stages being set by said imposition.

11. The time correction circuit as claimed in claim 9, wherein there is a plurality of said data terminals, one portion of said data terminals cooperating with one said set-reset circuit, another portion of said data terminals cooperating with the other said set-reset circuit, whereby coarse and fine adjustments can be made.

12. The time correction circuit as claimed in claim 1 or 9, wherein the first preferred output condition is detected on the divider stage on which a selected output condition is imposed.

13. The time correction circuit as claimed in claim 1 or 9, wherein the first preferred output condition is detected on another divider stage from the divider stage on which a selected output is imposed.

14. The time correction circuit as claimed in claim 9, wherein the second preferred output condition is detected on a divider stage on which a selected output condition is imposed.

15. The time correction circuit as claimed in claim 9, wherein the second preferred output condition is detected on another divider stage from the divider stage on which a selected output is imposed.

* * * * *